United States Patent [19]

Hatta et al.

[11] 4,152,626

[45] May 1, 1979

[54] COMPENSATION FOR HALF SELECTION IN A DRIVE SYSTEM FOR A THIN-FILM EL DISPLAY

[75] Inventors: Tadashi Hatta, Nagaokakyo; Matsuhiko Hirano, Yamatokoriyama; Sumio Kita; Shinobu Shiotani, both of Nara, all of Japan

[73] Assignee: Sharp Kabushiki Kaisha, Osaka, Japan

[21] Appl. No.: 829,422

[22] Filed: Aug. 31, 1977

[30] Foreign Application Priority Data

Sep. 3, 1976 [JP] Japan ..... 51-106517

[51] Int. Cl.[2] ..... H05B 37/00; H05B 39/00; H05B 41/00

[52] U.S. Cl. ..... 340/781; 340/166 EL; 340/802; 340/805; 315/169.3

[58] Field of Search ..... 313/498, 500, 509; 315/169 R, 169 TV; 340/166 EL, 324 M

[56] References Cited

U.S. PATENT DOCUMENTS

| | | | |
|---|---|---|---|
| 3,343,128 | 9/1967 | Rogers | 340/166 R |
| 3,614,769 | 10/1971 | Coleman | 315/169 TV |
| 3,629,653 | 12/1971 | Irwin | 315/169 TV |
| 3,674,928 | 7/1972 | Yoshiyama | 315/169 TV X |

*Primary Examiner*—Alfred E. Smith
*Assistant Examiner*—Robert E. Wise
*Attorney, Agent, or Firm*—Birch, Stewart, Kolasch and Birch

[57] ABSTRACT

A drive system is provided for a thin-film EL display panel which includes and EL thin layer sandwiched between a pair of dielectric layers, a plurality of scanning line electrodes formed on one of the dielectric layers, and a plurality of data line electrodes formed on the other of the dielectric layers. The scanning line electrodes and the data line electrodes, in combination, define a matrix pattern. Scanning pulses are sequentially applied to the scanning line electrodes, and a data sugnal is applied to the data line electrode which includes a selected picture point where the data line electrode crosses the scanning line electrode which is receiving the scanning pulse. Scanning line electrodes which are not receiving the scanning pulse are connected to receive a voltage signal of which a level is below the threshold level of the light emission.

29 Claims, 10 Drawing Figures

FIG. 5
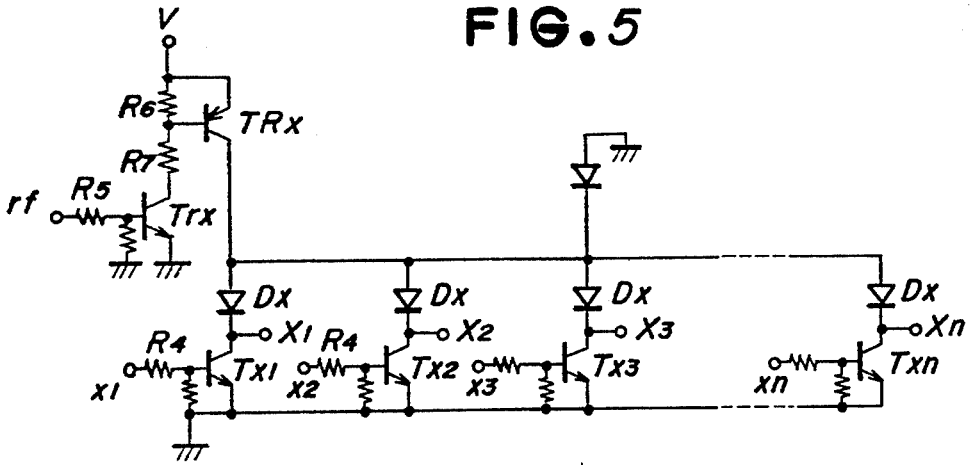
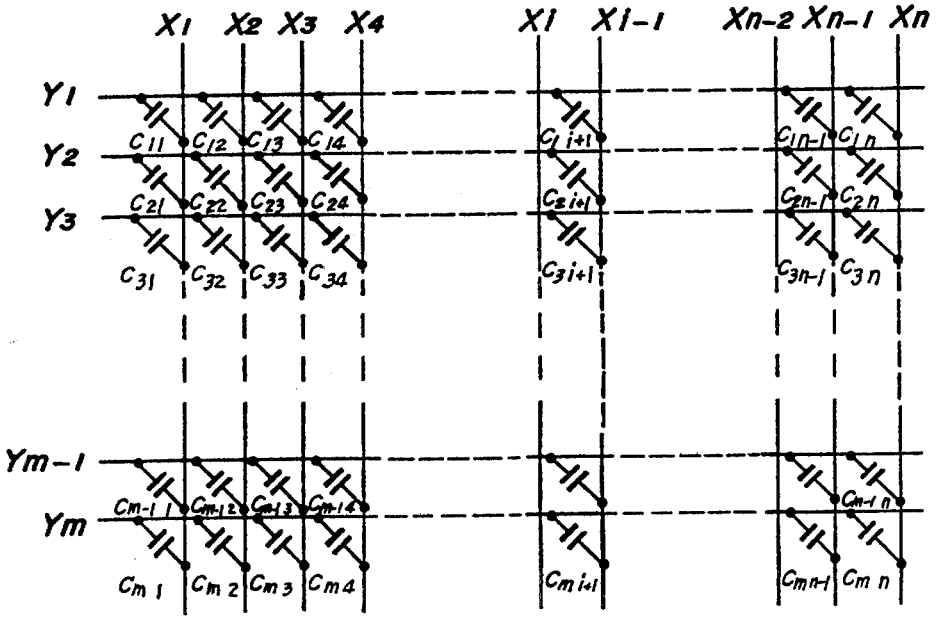
FIG. 6

COMPENSATION FOR HALF SELECTION IN A DRIVE SYSTEM FOR A THIN-FILM EL DISPLAY

BACKGROUND OF THE INVENTION

The present invention relates to a drive system for a thin-film EL display device, which includes an EL thin layer sandwiched between a pair of dielectric layers and, more particularly, to a drive system for a thin-film EL matrix display panel.

A thin-film EL element can stably provide electroluminescence of high brightness. Therefore, a flat matrix display is developed, wherein a plurality of data line electrodes and a plurality of scanning line electrodes are formed on a pair of dielectric layers, between which an EL thin layer is sandwiched, in a matrix fashion. A desired data line and a desired scanning line are connected to receive high voltages so as to provide the electroluminescence at a picture point where selected data line and scanning line cross each other, whereby a desired symbol or picture is displayed in a dot matrix fashion.

In the above-mentioned drive system, when the number of data line electrodes connected to receive a data signal increases, there is a possibility that half-selected picture points, where the nonselected data line electrode and the scanning line electrode which is receiving the scanning signal cross each other, provide light emission. This deteriorates the display quality.

OBJECTS AND SUMMARY OF THE INVENTION

Accordingly an object of the present invention is to provide a novel drive system for a thin-film EL display device.

Another object of the present invention is to enhance the contrast of a displayed image in a thin-film EL matrix display panel.

Still another object of the present invention is to stabilize write-in operation in a drive system for a thin-film EL matrix display panel.

Yet another object of the present invention is to provide a drive system for a thin-film EL matrix display panel, which can prevent erroneous write-in operation to a half-selected picture point.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, scanning pulses are sequentially applied to scanning line electrodes, and a data signal is applied to a data line electrode which includes a selected picture point where the data line electrode crosses the scanning line electrode which is receiving the scanning pulse. A voltage signal of which a level is below the threshold level of the light emission is applied to scanning line electrodes which are not receiving the scanning pulse. In this way, the half-selected picture point is compensated for even when the number of picture points to be selected is extremely great.

In a preferred form, a refresh pulse is applied to whole picture points included within the thin-film EL display panel after completion of the scanning of one field. The selected picture point again provides the electroluminescence upon receiving the refresh pulse of which a polarity is opposite to that of the write-in pulse.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

FIG. 5 is a circuit diagram of a typical driver circuit for driving data electrodes;

FIG. 6 is an equivalent circuit diagram of a typical thin-film EL matrix display panel;

DESCRIPTION OF THE PREFERRED EMBODIMENTS

Figure 1:
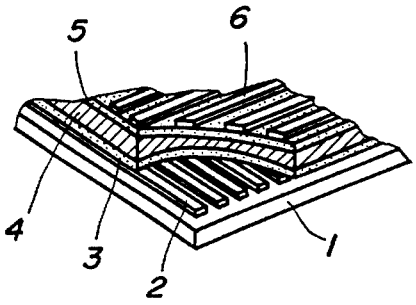
FIG. 1 is a perspective view showing a typical construction of a thin-film EL matrix display panel.

Referring now in detail to the drawings, and to facilitate a more complete understanding of the present invention, a typical construction of a thin-film EL matrix display panel will be first described with reference to FIGS. 1 and 2.

A plurality of transparent, parallel line electrodes 2 made of $In_2O_3$ are formed on a glass substrate 1. A dielectric film 3 made of, for example, $Y_2O_3$ or $Si_3N_4$ is formed on the transparent, parallel line electrodes 2 and the glass substrate 1, and upon which an electroluminescent layer 4 made of a ZnS thin-film doped with manganese by 0.1–5.0 wt % is formed. Another dielectric film 5 made of, for example, $Y_2O_3$ or $Si_3N_4$ is formed on the electroluminescent layer 4. These dielectric films 3 and 5, and the electroluminescent layer 4 are formed through the use of evaporation techniques or a spattering method to the thickness of 500–10000 Å. A plurality of counter, parallel line electrodes 6 made of aluminum are formed on the dielectric layer 5 in such a manner that the electrodes 2 and 6 cross each other at a right angle.

With such an arrangement, a matrix drive can be achieved by applying selection alternating signals to the electrodes 2 and 6. A picture point where the selected electrodes 2 and 6 cross each other provides electroluminescence.

The above-mentioned thin-film EL element can stably provide electroluminescence of high brightness and is superior to the conventional EL element of the distribution type. A flat matrix display has been developed through the use of thin-film EL element of the above-mentioned type.

Figure 2:
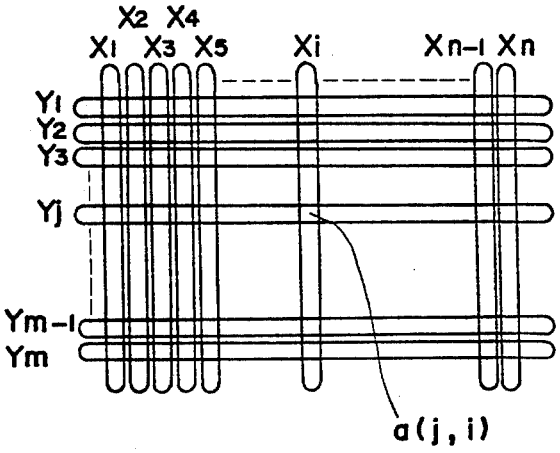
FIG. 2 is a plan view showing an electrode layout of the thin-film EL matrix display panel of FIG. 1.

FIG. 2 shows a layout of the electrodes 2 and 6. The electrodes 2 function as data electrodes $X_1$ through $X_n$, and the electrodes 6 function as scanning electrodes $Y_1$ through $Y_m$. In a typical EL matrix panel the number of the data electrodes $X_1$ through $X_n$ is greater than that of the scanning electrodes $Y_1$ through $Y_m$.

A typical drive system of the thin-film EL mattrix display panel will be described with reference to FIG. 3.

The scanning electrodes $Y_1$ through $Y_m$ are connected to receive scanning pulses SY which are sequentially developed as shown $SY_1$ through $SY_m$ and have a voltage level higher than the threshold level of electroluminescence. The scanning signals $SY_1$ through $SY_m$ are applied to the scanning electrodes $Y_1$ through $Y_m$, respectively. Switching means connected to the respective scanning electrodes are maintained OFF during a time period when the scanning pulse is not applied. That is, the scanning electrodes are placed in the opened condition when the scanning pulse is not applied. FIG. 3 shows the opened condition by dotted lines. The data electrodes $X_1$ through $X_n$ are selected in accordance with the character information or the pattern information to be displayed. A selected data electrode is held at the ground potential through a switching means connected to the selected data electrode. Switching means connected to non-selected data electrodes are maintained OFF and, therefore, the non-selected data electrodes are placed in the open condition. The open condition is shown by dotted lines in FIG. 3.

In this way, the scanning pulses SY are sequentially applied to the scanning electrodes and a data signal is applied to a selected data electrode to ground the selected data electrode. When the scanning is completed to the last scanning electrode, that is, when the one frame scanning is completed, a field refresh pulse RF is applied to the whole picture points of the thin-film EL matrix display panel through the scanning electrodes and the data electrodes. The field refresh pulse RF functions to prevent the occurrence of inclination of polarization at a selected picture point of the thin-film EL matrix display panel, thereby securing the following write-in operation. The field refresh pulse RF also functions to provide light emission at a picture point which is previously selected at the preceding frame, thereby increasing the brightness.

The field refresh pulse, RF, has the same amplitude as, and is of opposite polarity to, the write-in pulses applied to the thin-film EL matrix display panel during the frame period. In this example, positive pulses are applied to the data electrodes $X_1$ through $X_n$, while the scanning electrodes $Y_1$ through $Y_m$ are maintained at the ground potential. The level of the refresh pulse must be determined so that the superimposed level of the refresh pulse and the polarization level exceeds the threshold level of the electroluminescence when the refresh pulse is superimposed in the counter direction to the polarization, but does not exceed the threshold level when the refresh pulse is superimposed in the same direction as the polarization. By the way, the polarization voltage is gradually increased by the application of voltage pulses of the same polarity.

Figure 3:
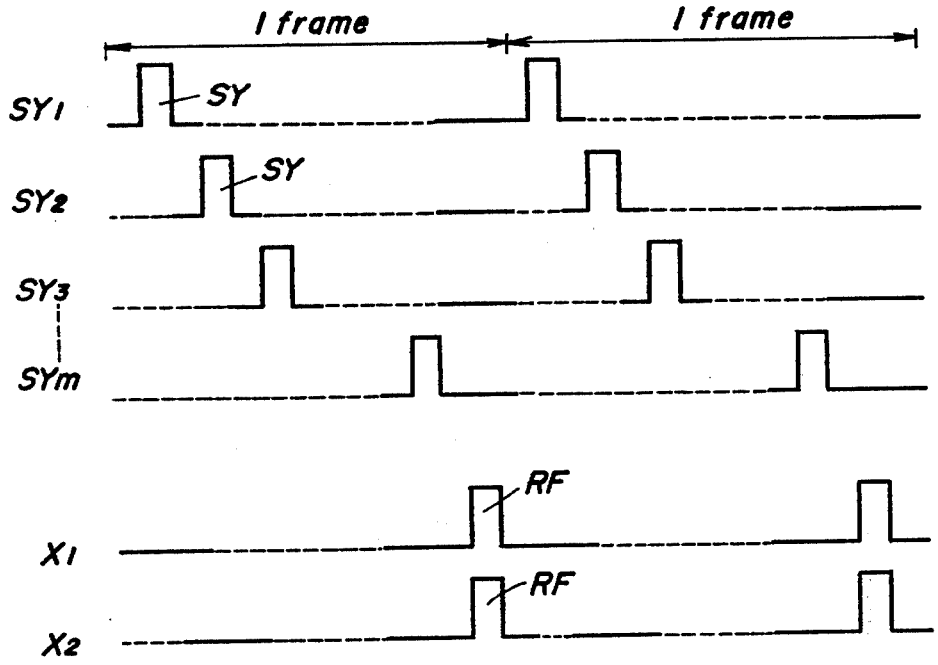
FIG. 3 is a time chart for explaining a typical drive system of a thin-film EL matrix display panel.
Figure 4:
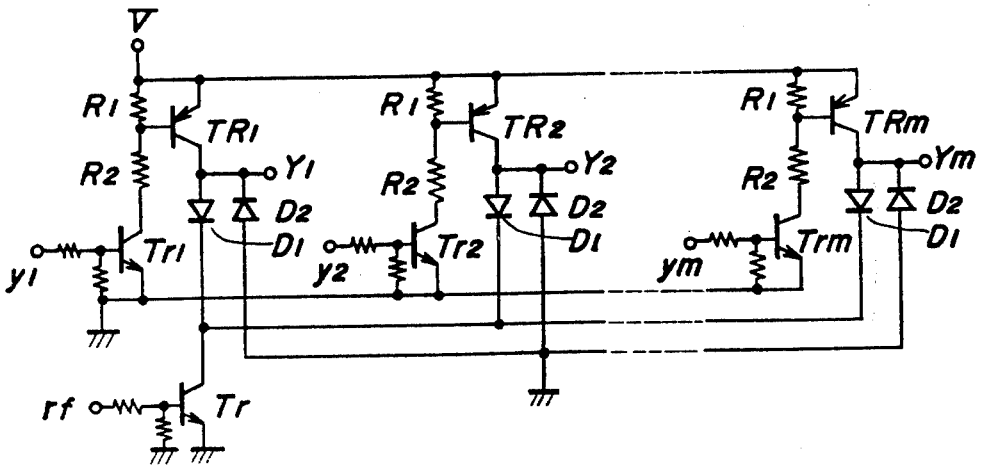
FIG. 4 is a circuit diagram of a typical driver circuit for driving scanning electrodes.

FIGS. 4 and 5 show driver circuits for achieving the FIG. 3 drive system. More specifically, FIG. 4 shows a driver circuit of the scanning side and FIG. 5 shows a drive circuit of the data side.

A terminal V is connected to a positive D.C. power source. The scanning electrodes $Y_1$ through $Y_m$ are connected to receive the scanning signals $SY_1$ through $SY_m$ via switching transistors $TR_1$ through $TR_m$. The positive D.C. power source has a level higher than the threshold level of the electroluminescence. The switching transistors $TR_l$ through $TR_m$ are controlled by transistors $Tr_1$ through $Tr_m$, respectively, which receive scanning control pulses $y_1$ through $y_m$ at their base electrodes, respectively. The switching transistors $TR_1$ through $TR_m$ are sequentially conducted in response to the scanning control pulses $y_1$ through $y_m$, thereby sequentially developing the scanning pulses toward the thin-film EL matrix display panel.

A signal, rf, is applied to a transistor Tr at a time when the refresh pulse RF is applied to the thin-film EL matrix display panel. When the transistor Tr is conducted by the signal rf, all scanning electrodes $Y_1$ through $Y_m$ are maintained at the ground potential through a diode $D_1$.

The data electrodes $X_1$ through $X_n$ are connected to switching transistors $Tx_1$ through $Tx_n$, respectively. The switching transistors $Tx_1$ through $Tx_n$ are controlled by data signals $x_1$ through $x_n$ so as to maintain the selected data electrode at the ground potential. Accordingly, the selected picture point provides the electroluminescence when the scanning pulse is applied to the scanning electrodes $Y_1$ through $Y_m$.

Transistors $Tr_x$ and $TR_x$ are conducted at a time when the refresh signal rf is developed, whereby the D.C. voltage V is applied to the whole data electrodes so that the refresh pulse RF is applied to every picture point.

Every picture point of the thin-film EL matrix display panel can be considered as a capacitive component, since the thin-film EL matrix display panel includes the scanning electrodes $Y_1$ through $Y_m$ formed on the dielectric layer 5 and the data electrodes $X_1$ through $X_n$ formed on the dielectric layer 3.

The equivalent circuit of the thin-film EL matrix display panel can be shown as FIG. 6, when the electrode resistance is neglected.

Now consider that the scanning electrode $Y_1$ is selected and data electrodes xi ($1<i<n$) are selected. The voltage V is applied between the scanning electrode $Y_1$ and the selected xi data electrodes. Non-selected scanning and data electrodes are placed in the opened conditions. Accordingly, the equivalent circuit can be expressed as the equivalent circuit of FIG. 7.

Figure 8:
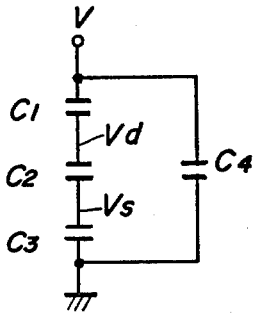
FIG. 8 is a simplified equivalent circuit diagram of the equivalent circuit of FIG. 7.

When the respective picture points have a capacitance C, the equivalent circuit can be modified as the equivalent circuit of FIG. 8.

In FIG. 8, each symbol has the following meaning:

$C_1=(n-i)\times C$ $C_2=(m-1)\times(n-i)\times C$ $C_3=(m-1)i\times C$ $C_4=i\times C$ $V_d$: a voltage level of a connection point of the capacitance $C_1$ and $C_2$ $V_s$: a voltage level of a connection point of the capacitance $C_2$ and $C_3$ The voltage level $V_d$ of the data electrode connected to a half-selected picture point where the selected scanning electrode and the non-selected data electrode cross each other can be expressed as follows:

$$V_d = \frac{nV}{(m-1)i+n}$$

It will be clear that the level $V_d$ approximates the ground potential as the number i of the selected data electrodes increases. Therefore, there is a possibility that the half-selected picture points on the selected scanning line provide light emission when the great number of data electrodes are selected. This will deteriorate the display quality or the display contrast.

To eliminate the above-mentioned undesirable light emission, in accordance with the present invention, non-selected scanning electrodes are connected to receive a pulse having an amplitude of $\frac{1}{2}V$, whereby the half-selected picture points are connected not to receive the voltage higher than $\frac{1}{2}V$, where V is the threshold level of the electroluminescence.

Figure 9:
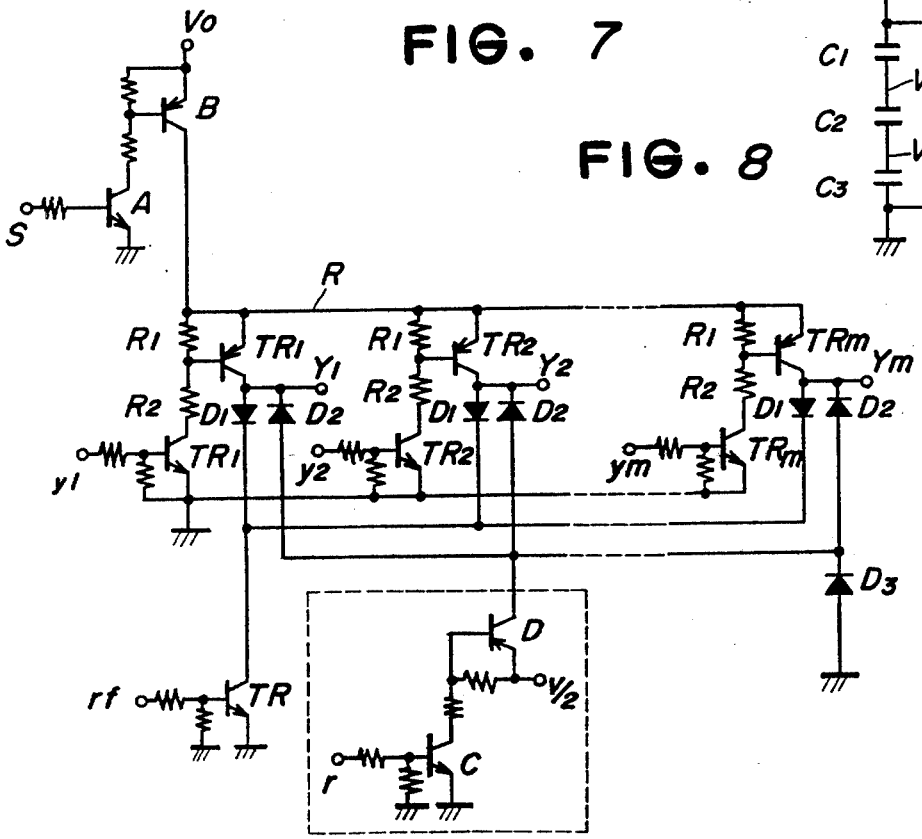
FIG. 9 is a circuit diagram of an embodiment of a driver circuit of the present invention for driving scanning electrodes.

FIG. 9 shows an embodiment of a driver circuit of the scanning side for compensating for the half selection. Like elements corresponding to those of FIG. 4 are indicated by like numerals.

Transistors A and B are connected by a signal S which takes the high level during the entire scanning period except a time when the refresh pulse is applied to the panel, thereby supplying a conductor R with a voltage $V_o$. The level of the voltage $V_o$ is determined to satisfy the following relationship.

$$V_o < 2V_{th}$$

where: $V_{th}$ is the threshold level of the electroluminescence of the thin-film EL matrix display panel.

Transistors C and D are controlled by signal r which takes the high level in response to the scanning signals $SY_1$ through $SY_m$ to supply the scanning electrodes $Y_1$ through $Y_m$ with the voltage $V_o/2$ through a diode $D_2$. The voltge $V_o/2$ functions to compensate for the half selection of the entire scanning electrodes.

The driver circuit of the data side is same as the driver circuit of FIG. 5. Operation of the drive system will be described with reference to the FIG. 10 time chart.

When a picture point $a_{11}$ ($X_1$, $Y_1$) (a picture point where the scanning electrode $Y_1$ and the data electrode $X_1$ cross each other) is desired to provide electroluminescence, the data electrode $X_1$ is maintained at the ground potential during a time period when the scanning pulse of the voltage level $V_o$ is applied to the scanning electrode $Y_1$.

When a picture point $a_{21}$ ($X_2$, $Y_1$) (a picture point where the scanning electrode $Y_1$ and the data electrode $X_2$ cross each other) is desired not to provide a electroluminescence, the data electrode $X_2$ is maintained in the opened condition during a time period when the scanning pulse $SY_1$ is applied to the scanning electrode $Y_1$. That is the switching transistor $Tx_2$ connected to the data electrode $x_2$ is maintained OFF. During a time period when the scanning pulse $SY_1$ is applied to the scanning electrode $Y_1$, remaining scanning electrodes $Y_2$ through $Y_m$ are connected to receive half-selection-compensation pulse $CY_2$ through $CY_m$ of the voltage level of $V_o/2$ through the transistor D.

When the scanning pulse $SY_2$ is applied to the scanning electrode $Y_2$, the remaining scanning electrode $Y_1$, $Y_3$ through $Y_m$ are connected to receive the half-selection-compensation pulses $CY_1$, $CY_3$ through $CY_m$ of the voltage level of $V_o/2$. And the data electrode including a selected picture point where the scanning electrode $Y_2$ runs is maintained at the ground potential, whereas the remaining data electrodes associated with the non-selected picture points are placed in the opened conditions.

The scanning operation is conducted to the last scanning electrode $Y_m$. Thereafter the field refresh pulse RF is applied to the entire picture points.

When the scanning pulse is applied to a certain scanning electrode, the voltage level $V_s$ of the connection point of the capacitance $C_2$ and the capacitance $C_3$ (see FIG. 8) is fixed at the compensation level $V_o/2$. Therefore, the half-selected picture points where the selected scanning electrode receiving the scanning pulse and the non-selected data electrodes placed in the opened condition cross each other (corresponding to, for example, the points $C_{1i+1}$ and $C_{1i+2}$, etc. of FIG. 7) receive the following voltage $V_2$ during a time period when the scaning pulse is applied to the selected scanning electrode, since the voltage $V_o$12 is divided by the capacitance $C_1$ and the capacitance $C_2$ (see FIG. 8).

$$V_2 = \frac{V_o}{2} \cdot \frac{m-1}{m}$$

Figure 7:
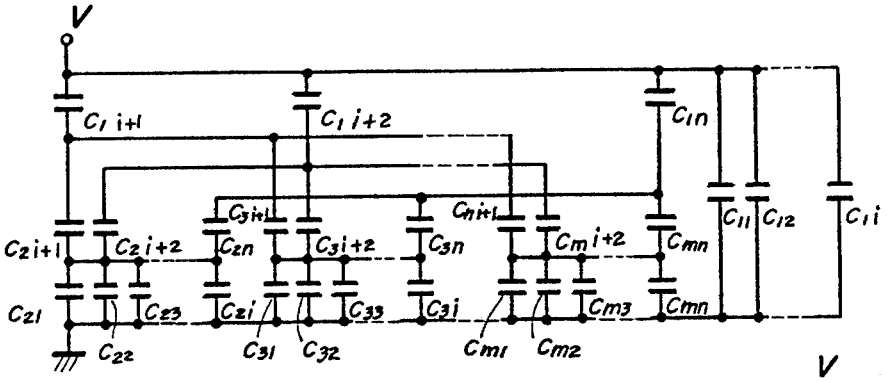
FIG. 7 is an equivalent circuit diagram of one operation mode of the typical thin-film EL matrix display panel.

The half-selected picture points where the non-selected scanning electrodes receiving the half-selection-compensation pulses and the selected data electrodes maintained at the ground potential cross each other (corresponding to, for example, the points $c_{21}$ and $c_{23}$, etc. of FIG. 7) receive the voltage $V_o/2$ during a time period when the half-selection-compensation pulses are applied thereto. The voltage $V_o/2$ is below the threshold level of the electroluminescence and, hence, these picture points do not provide the electroluminescence.

The non-selected picture points where the non-selected scanning electrodes receiving the half-selection-compensation voltage $V_o/2$ and the non-selected data electrodes placed in the opened condition cross each other (corresponding to, for example, the points $C_{2i+1}$ and $C_{2i+2}$, etc. of FIG. 7) receive the following voltage $V_1$ during a time period when the scanning pulse is applied thereto, since the voltage $V_o/2$ is divided by the capacitance $C_1$ and the capacitance $C_2$ (see FIG. 8).

$$V_1 = (V_o/2) \cdot (1/m)$$

The voltage $V_1$ is also below the threshold level of the electroluminescence.

Figure 10:
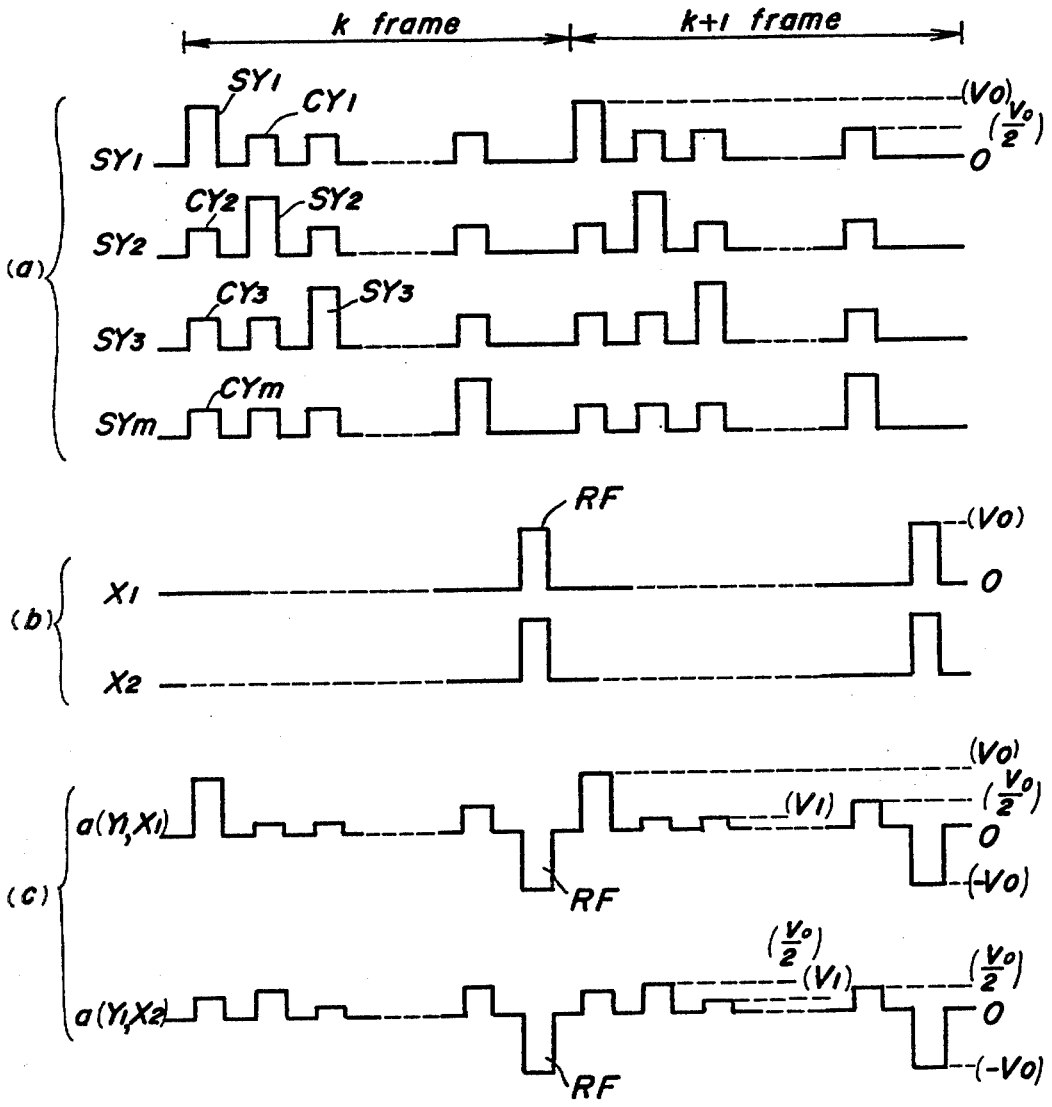
FIG. 10 is a time chart for explaining operation of the driver circuit of FIG. 9.

Although, in the embodiment of FIGS. 9 and 10, the half-selection-compensation pulse is determined at the voltage level of $V_o/2$, the half-selection-compensation voltage is required to satisfy the following relationships.

$$V_s < V_{th}$$

$$V_o - V_s < V_{th}$$

The display contrast is increased by provision of the half-selection-compensation pulses, because the half-selected picture points and the non-selected picture points do not provide the electroluminescence even when the number of selected data electrodes is increased. The invention being thus described, it will be obvious that the same may be varied in many ways. Such variations are not to be regarded as a departure from the spirit and scope of the invention, and all such modifications are intended to be included within the scope of the following claims.

What is claimed is:

1. A drive system for a thin-film EL matrix display panel, said panel including a thin-film EL matrix display panel, said panel including a thin-film EL element sandwiched between a pair of dielectric layers, a set of scanning electrodes formed on one of said dielectric layers, and a set of data electrodes formed on the other of said dielectric layers, comprising:

means for sequentially applying a scanning pulse to said set of scanning electrodes;

means for applying a data signal to a data electrode simultaneously with said application of said scanning pulses to said scanning electrodes said data signal being continually applied to said data electrode during said application of said scanning pulses to said set of scanning electrodes within a single frame;

means for applying half-selection-compensation voltage signals to said electrodes which are not receiving a said scanning pulse simultaneously with said application of said scanning pulses to said scanning electrodes; and means responsive to the completion of said application of said scanning pulse to said set of scanning electrodes within said single frame, for applying a field-refresh pulse to all of said data electrodes and concurrently applying a ground potential to all of said scanning electrodes.

2. The drive system of claim 1, wherein said half-selection-compensation voltage signals have an amplitude below a threshold level of electroluminescence of said thin-film EL element.

3. The drive system of claim 2, wherein said scanning pulse has an amplitude higher than said threshold level of the electroluminescence of said thin-film EL element, and said half-selection-compensation voltage signals have a half amplitude of that of said scanning pulse.

4. The drive system of claim 1, wherein the application of said half-selection-compensation voltage signals is timed in agreement with the application of said scanning pulse.

5. The drive system of claim 4, wherein said data signal is of ground potential.

6. The drive system of claim 5, wherein the data electrodes not selected to receive said data signal are placed in an opened condition.

7. The drive system of claim 1, which further comprises means for applying a field refresh pulse to the entire picture points of said thin-film EL matrix display panel after completion of a scan of one frame.

8. The drive system of claim 7, wherein said field refresh pulse has the same amplitude as said scanning pulse, and said field refresh pulse is applied to said thin-film EL matrix display panel in a counter direction to that of said scanning pulse.

9. A drive system for a thin-film EL display panel, said panel including a thin-film EL element sandwiched between a pair of dielectric layers, a set of selection electrodes formed on one of said dielectric layers, and a set of counter electrodes formed on the other dielectric layer, comprising:

means for sequentially applying a timing pulse to said counter electrodes;

means for applying a data signal to a selected selection electrode including a picture point to be selected associated with a counter electrode which is receiving said timing pulse;

means for applying voltage signals to said counter electrodes which are not receiving said timing pulse; and means responsive to the completion of said application of said timing pulse to said set of counter electrodes for applying a field-refresh pulse to all of said selection electrodes and concurrently applying a ground potential to all of said counter electrodes.

10. The drive system of claim 9, wherein said timing pulse has an amplitude higher than the threshold level of electroluminescence of said thin-film EL element, and said voltage signals have an amplitude less than the threshold level of the electroluminescence of said thin-film EL element.

11. A drive system for a thin-film EL matrix display panel in accordance with claim 1 wherein said means for sequentially applying a scanning pulse to said set scanning electrodes comprises:

a first series of cascaded circuit means, having inputs and outputs, said input of each of said first cascaded circuit means being responsive to a scanning signal, and said output of each of said first cascaded circuit means being connected to one of said scanning electrodes;

a second circuit means having an output and interconnected to said series of first cascaded circuit means;

said output of said second circuit means being connected to a supply source for said scanning pulse;

said series of first cascaded circuit means and said second circuit means being interconnected to transfer said scanning pulse from said output of said second circuit means to an output of one of said series of first cascaded circuit means in response to an application of said scanning signal at said input of said one of said series of cascaded circuit means.

12. A drive system for a thin-film EL matrix display panel in accordance with claim 11 wherein said means for applying half-selection-compensation voltage signals to said scanning electrodes which are not receiving said scanning pulse comprises:

a third circuit means having an output and interconnected to said first series of cascaded circuit means and said second circuit means to transfer said half-selection-compensation voltage signal from said output of said third circuit means to all of said outputs of said first series of cascaded circuit means, not occupied by said scanning pulse.

13. A drive system for a thin-film EL matrix display panel in accordance with claim 12 wherein said means for applying a data signal to a single data electrode comprises:

a second series of cascaded circuit means having inputs and outputs, each said input of said second cascaded circuit means being responsive to data signals and each said output of said second cascaded circuit means being connected to a corresponding one of said data electrodes;

said data signal being sequentially applied to each of said inputs of said second cascaded circuit means;

said second series of cascaded circuit means transferring said data signal from one said input of said second cascaded circuit means to a corresponding said output of said second cascaded circuit means in response to said data signal, thereby supplying said data signal to said corresponding data electrode and maintaining said other, remaining data electrodes in an open circuit condition.

14. A drive system for a thin-film EL matrix display in accordance with claim 13 wherein said means for applying a field-refresh pulse to said data electrodes concurrently with the application of a ground potential to said scanning electrodes comprises:

means for supplying a field-refresh signal;

a fourth circuit means having an input and interconnected with said first series of cascaded circuit means;

a fifth circuit means having an input and interconnected with said second series of cascaded circuit means;

said inputs of said fourth and fifth circuit means being responsive to said field-refresh signal;

said fourth circuit means comprising, means responsive to said field-refresh signal for applying a ground potential to all of said outputs of said first cascaded circuit means, thereby supplying said ground potential to all of said scanning electrodes, simultaneously; and said fifth circuit means comprising, means responsive to said field-refresh signal for applying a field-refresh pulse to all of said outputs of said second series of cascaded circuit means, thereby supplying said field-refresh pulse to all of said data electrodes, simultaneously.

15. A thin-film EL matrix display panel and drive system comprising:

a glass substrate;

a plurality of first transparent parallel line electrode means formed on said glass substrate;

a first thin dielectric film formed on said transparent, parallel line electrodes;

a thin-film electroluminescent layer having a threshold level of electroluminescence formed on said first thin dielectric layer;

a second thin dielectric film formed on said electroluminescent layer;

a plurality of second transparent parallel line electrode means formed on said second thin dielectric layer, wherein said first and second parallel line electrodes cross each other at right angles;

said first parallel line electrode means comprising a set of data electrodes and said second parallel line electrode means comprising a set of scanning electrodes;

means for sequentially applying a scanning pulse to said scanning electrodes;

means for applying a data signal to a selected data electrode simultaneously with the application of said scanning pulse to said scanning electrodes; and means for applying half-selection-compensation voltage signals to said scanning electrodes which are not receiving said scanning pulse simultaneously with the application of said scanning pulse to said scanning electrodes.

16. A thin-film EL matrix display panel and drive system in accordance with claim 15 further comprising:

means responsive to the completion of said application of said scanning pulse to said set of scanning electrodes within said single frame for applying a field-refresh pulse to all of said data electrodes concurrently with the application of a ground potential to all of said scanning electrodes.

17. The matrix display panel and drive system of claim 15 wherein said half-selection-compensation voltage signals have an amplitude below said threshold level of electroluminescence of said thin-film EL element.

18. The matrix display panel and drive system of claim 17 wherein said scanning pulse has an amplitude higher than said threshold level of the electroluminescence of said thin-film EL element, and said half-selection-compensation voltage signals have a half amplitude of that of said scanning pulse.

19. The matrix display panel and drive system of claim 15 wherein the application of said half-selection-compensation voltage signals is timed in agreement with the application of said scanning pulse.

20. The matrix display panel and drive system of claim 19 wherein said data signal is of ground potential.

21. The matrix display panel and drive system of claim 20 wherein the data electrodes not selected to receive said data signal are placed in an opened condition.

22. The matrix display panel and drive system of claim 15 wherein said scanning pulse has an amplitude higher than said threshold level of electroluminescence of said thin-film EL element, and said voltage signals have an amplitude less than said threshold level of the electroluminescence of said thin-film EL element.

23. The matrix display panel and drive system in accordance with claim 15 wherein said means for sequentially applying a scanning pulse to said set of scanning electrodes comprises:

a first series of cascaded circuit means, having inputs and outputs, said input of each of said first cascaded circuit means being responsive to a scanning signal, and said output of each of said first cascaded circuit means being connected to one of said scanning electrodes;

a second circuit means having an output and interconnected to said series of first cascaded circuit means;

said output of said second circuit means being connected to a supply source for said scanning pulse;

said series of first cascaded circuit means and said second circuit means being interconnected so as to transfer said scanning pulse from said output of said circuit means to an output of one of said series of first cascaded circuit means in response to an application of said scanning signal at said input of said one of said series of cascaded circuit means.

24. The matrix display panel and drive system in accordance with claim 23 wherein said means for applying half-selection-compensation voltage signals to said scanning electrodes which are not receiving said scanning pulse comprising:

a third circuit means having an output and interconnected to said first series of cascaded circuit means and said second circuit means to transfer said half-selection-compensation voltage signal from said output of said third circuit means to all of said outputs of said first series of cascaded circuit means, not occupied by said scanning pulse.

25. The matrix display panel and drive system in accordance with claim 24 wherein said means for applying a data signal to a single data electrode comprises:

a second series of cascaded circuit means having inputs and outputs, each said input of said second cascaded circuit means being responsive to data signals and each said output of said second cascaded circuit means being connected to a corresponding one of said data electrodes;

said data signal being sequentially applied to each of said inputs of said second cascaded circuit means;

said second series of cascaded circuit means transferring said data signal from one said input of said second cascaded circuit means to a corresponding said output of said second cascaded circuit means in response to said data signal, thereby supplying said data signal to said corresonding data electrode and maintaining said other, remaining data electrodes in an open circuit condition.

26. The matrix display panel and drive system in accordance with claim 16 wherein said means for sequentially applying a scanning pulse to said set of scanning electrodes comprises:

a first series of cascaded circuit means having inputs and outputs, said input of each of said first cascaded circuit means being responsive to a scanning signal and said output of each of said first cascaded circuit means being connected to one of said scanning electrodes;

a second circuit means having an output and interconnected to said series of first cascaded circuit means;

said output of said second circuit means being connected to a supply source for said scanning pulse;

said series of first cascaded circuit means and said second circuit means being interconnected to transfer said scanning pulse from said output of said second circuit means to an output of one of said series of first cascaded circuit means in response to an application of said scanning signal at said input of said one of said series of cascaded circuit means.

27. The matrix display panel and drive system in accordance with claim 26 wherein said means for applying half-selection-compensation voltage signals to said scanning electrodes which are not receiving said scanning pulse comprising:

a third circuit means having an output and interconnected to said first series of cascaded circuit means and said second circuit means to transfer said half-selection-compensation voltage signal from said output of said third circuit means to all of said outputs of said first series of cascaded circuit means, not occupied by said scanning pulse.

28. The matrix display panel and drive system in accordance with claim 27 wherein said means for applying a data signal to a single data electrode comprises:

a second series of cascaded circuit means having inputs and outputs, each said input of said second cascaded circuit means being responsive to data signals and each output of said second cascaded circuit means being connected to a corresponding one of said data electrodes;

said data signal being sequentially applied to each of said inputs of said second cascaded circuit means;

said second series of cascaded circuit means transferring said data signal from one said input of said second cascaded circuit means to a corresponding said output of said second cascaded circuit means in response to said data signal thereby supplying said data signal to said corresponding data electrode and maintaining said other, remaining data electrodes in an open circuit condition.

29. The matrix display panel and drive system in accordance with claim 28 wherein said means for applying a field-refresh pulse to said data electrodes concurrently with the application of a ground potential to said scanning electrodes comprises:

means for supplying a field-refresh signal;

a fourth circuit means having an input and interconnected with said first series of cascaded circuit means;

a fifth circuit means having an input and interconnected with said second series of cascaded circuit means;

said inputs of said fourth and fifth circuit means being responsive to said field-refresh signal;

said fourth circuit means comprising, a means responsive to said field-refresh signal for applying a ground potential to all of said outputs of said first cascaded circuit means, thereby supplying said ground potential to all of said scanning electrodes, simultaneously; and said fifth circuit means comprising, a means responsive to said field-refresh signal for applying a field-refresh pulse to all of said outputs of said second series of cascaded circuit means, thereby supplying a field-refresh pulse to all of said data electrodes, simultaneously.

* * * * *